US005764203A

United States Patent [19]

Holmlund et al.

[11] Patent Number: 5,764,203

[45] Date of Patent: Jun. 9, 1998

[54] BREATHING MASK WITH A DISPLAY UNIT

[75] Inventors: Timo Erkki Holmlund; Raimo Antero Kujanpää ; Rauno Aulis Ollila, all of Vaasa, Finland

[73] Assignee: Kemira Oy, Helsinki, Finland

[21] Appl. No.: 699,171

[22] Filed: Aug. 19, 1996

Related U.S. Application Data

[63] Continuation of Ser. No. 435,527, May 5, 1995, abandoned, which is a continuation of Ser. No. 156,854, Nov. 23, 1993, abandoned.

[30] Foreign Application Priority Data

Dec. 1, 1992 [FI] Finland ..... 925471

[51] Int. Cl.[6] ..... G09G 5/00

[52] U.S. Cl. ..... 345/8; 359/630

[58] Field of Search ..... 345/4, 5, 6, 44, 345/35, 87, 64, 50–52, 102, 7–9; 340/980; 425/816; 359/630, 632

[56] References Cited

U.S. PATENT DOCUMENTS

| | | | |
|---|---|---|---|
| 3,712,714 | 1/1973 | Uyeda et al. | 345/8 |
| 4,743,200 | 5/1988 | Welch . | |
| 4,878,046 | 10/1989 | Smith | 359/630 |
| 4,965,564 | 10/1990 | Fabry et al. | 345/102 |
| 5,033,818 | 7/1991 | Barr | 359/630 |
| 5,164,715 | 11/1992 | Kashinahara et al. | 345/4 |
| 5,251,333 | 10/1993 | Tsook | 359/630 |
| 5,266,930 | 11/1993 | Ichikawa et al. | 359/630 |
| 5,281,957 | 1/1994 | Schoolman | 345/8 |

FOREIGN PATENT DOCUMENTS

| | | | |
|---|---|---|---|
| 0284389 | 9/1988 | European Pat. Off. . | |
| 1132451 | 11/1968 | United Kingdom . | |
| 2094640 | 9/1982 | United Kingdom . | |
| 2154757 | 9/1985 | United Kingdom | 345/7 |
| 9203756 | 3/1992 | WIPO . | |
| 9216867 | 10/1992 | WIPO . | |
| 9300134 | 1/1993 | WIPO . | |

OTHER PUBLICATIONS

Report entitled "Personal Information System and Display Unit Connected to a Respirator Mask", dated Aug. 10, 1995.

*Primary Examiner*—Xiao Wu

*Attorney, Agent, or Firm*—Loeb & Loeb LLP

[57] ABSTRACT

The invention relates to a breathing mask (1) having a display unit (5) comprising a display screen, the function of the unit being to display measurement data in the visual field of the mask wearer, the display screen being implemented by using a mechanical and/or electronic light modulator, the scales, symbols or other signs produced in the light modulator transmitting the measurement data to the wearer.

17 Claims, 1 Drawing Sheet

BREATHING MASK WITH A DISPLAY UNIT

Figure 1:
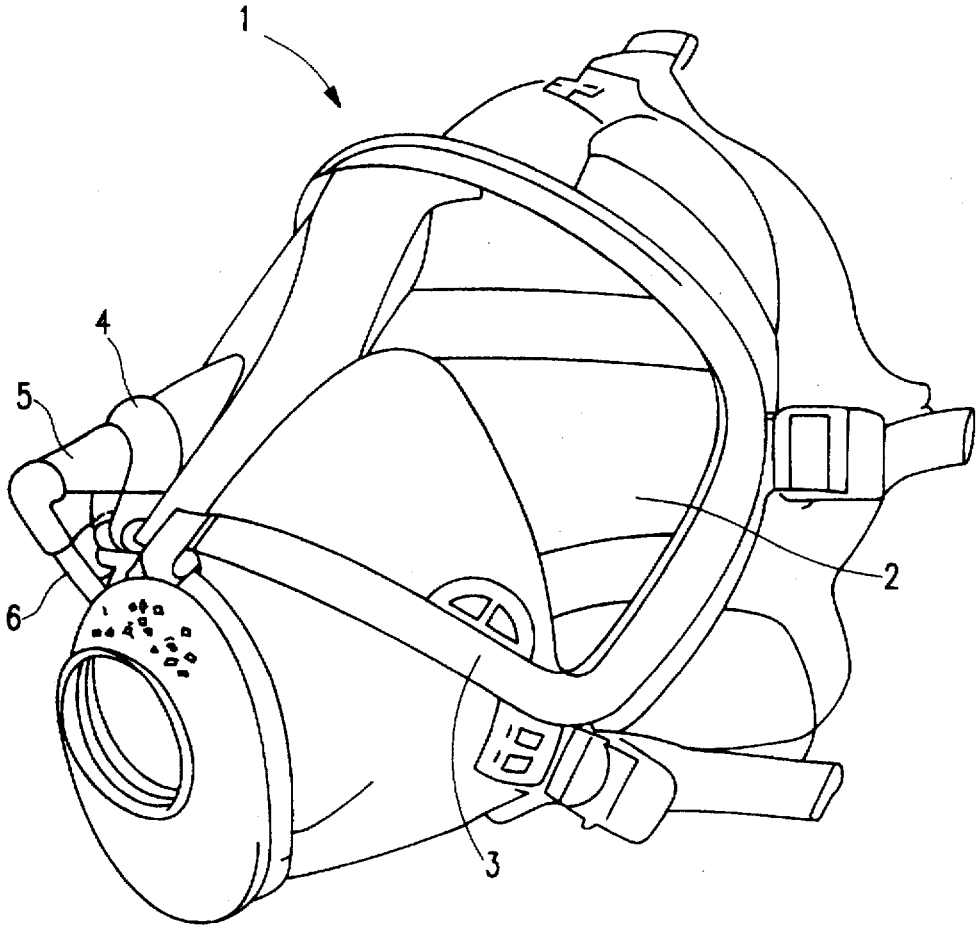

This is a continuation of application Ser. No. 08/435,527 filed on May 5, 1995, now abandoned, which is a continuation of application Ser. No. 08/156,854, filed Nov. 23, 1993, now abandoned.

The present invention relates to a breathing mask with a display unit comprising a display screen the function of which is to display measurement data in the visual field of the wearer of the mask.

Efforts have previously been made to improve the work safety of a wearer of a personal breathing mask by transmitting to the wearer measurement and alarm data of various environmental and apparatus quantities. Previously known devices for this purpose include various portable measuring devices, which usually have a sound alarm in addition to a display unit. The problem involved with these devices is their cumbersome use, because, when suspended from the wearer's neck, the measuring device may be snagged in protuberances in the surroundings and may have to be lifted up for viewing. Furthermore, in strenuous work in a noisy environment the sound alarm may not be heard.

Previously known are HEAD-UP DISPLAYS (HUD), used in fighter planes and in pilot helmets, by means of which the pilot may, without lowering his eyes, follow important information associated with flying. HUD is usually implemented by using hologram techniques. It is possible to make holograms at a very low cost in long series, but they need to be moved or illuminated from varying angles in order to produce the desired change in the display. This increases the complicatedness of the display unit and increases its cost.

There are also previously known breathing masks with a display unit, but the problem in the display of such masks is that, because of protective clothing and the requirement of wearability, it has to be placed very close to the eye, in which case normal numerical and dial displays cannot be distinguished properly. From EP patent publication 0 252 281 there is known a breathing mask of the type described at the beginning of the present specification, in which the display unit is placed inside the mask. This publication does not describe in greater detail the form in which the measurement data are shown in the display, but it is evident that the display screen shows only one measurement data item at a time, and if the purpose is to transmit a plurality of measurement data to the wearer, they are shown successively on the screen. Such a display method may divert the attention of the wearer of the breathing mask too much to the observation of the measuring data, and the performance of the actual work tasks will therefore suffer. The breathing mask disclosed in this publication has a further disadvantage in that the measurement signal is fed to the display unit inside the mask by means of a lead which will require in the mask a throughput, which may constitute a leakage point.

The object of the present invention is to provide a breathing mask with a display unit, avoiding the disadvantages of the systems described above, and in particular to provide economically for a personal breathing mask a display unit on which the wearer is able, without straining his eyes, to observe measurement and alarm data of environmental and apparatus quantities while his eyes are focussed at the working distance.

These objects have been achieved by means of the breathing mask according to the invention, the main characteristics of which are given in the accompanying patent claims.

The invention is based on the realization that the display screen of the display unit is implemented by using a mechanical and/or electronic light modulator (i.e. so-called mask), the scales, symbols and other signs produced on the screen transmitting the measurement data to the wearer. The use of a light modulator enables a plurality of data to be shown simultaneously on the display screen. The symbols or the like formed by the light modulator can be illuminated by using as the background light either ambient light or a separate light component or separate light components, for example a light-emitting diode, i.e. LED.

The mechanical light modulator may be, for example, a thin metal film on which the desired symbols are obtained by cutting the desired patterns by means of a laser or by etching them by photolithography. Thus a limited number of various symbols can be displayed using a mechanical light modulator. The displaying of new symbols will require the replacement of the modulator, as such a simple operation.

An electronic light modulator can be implemented, for example, by using liquid crystal technology. The symbols in the display can be changed according to the situation by reading out the contents of a new display from a memory component. In this case the number of different displays is in principle indefinite, the limiting factor being the capacity of the memory component.

A display unit according to the invention can be designed so that the display screen will be viewed through an optical system which enlarges the information displayed. In this case the physical dimensions of the display element can be made sufficiently small so that it will not cover too much of the visual field of the wearer. From this it also follows that the light modulator can be made very small, thus enabling economical manufacture by methods of, for example, microelectronics. The optics of a display unit according to the invention, comprising one or several lenses, can be made so as to make the light modulator to be seen as if at a greater distance than that at which it is actually located. Therefore the wearer can focus his eyes at the normal working distance and the display is still seen sharp. A breathing mask according to the invention can also be designed so that the light modulator and the optics associated with it are viewed via a mirror. The said mirror can be made so that it reflects intensively a light in accordance with the wavelength of the background light/lights of the light modulator and lets through most of other light. In this case the wearer will see a transparent sheet which will thus not limit his visual field, and the display of symbols formed by the light modulator is seen on this sheet. Such a use of a reflector makes possible also a more expedient mechanical structure of the display element. This is important when the display unit is placed inside a full-face mask, or when it is desirable to avoid protruding parts when it is placed outside a mask.

The transfer of information from detectors or from a central unit to a display unit according to the invention can be implemented by using metal leads or optical fibers, and also wirelessly by radio or by using an inductive loop. Wireless connection eliminates the need for throughputs when the display unit is placed inside a full-face mask.

The environmental and apparatus quantities to be measured may be, for example, carbon monoxide, explosive gases, hydrogen sulfide, multigas, particle concentration, bottle pressure (in smoke conditions), and temperature.

The breathing mask may be a full-face mask, in which the display unit is fitted either inside or outside the full-face mask, but it may also be a mask without a visor.

In case the display unit is outside a full-face mask, it is preferably fitted in a retainer fastened to the lower edge of the visor of the mask, the retainer being movable in the lateral direction.

Figure 2:
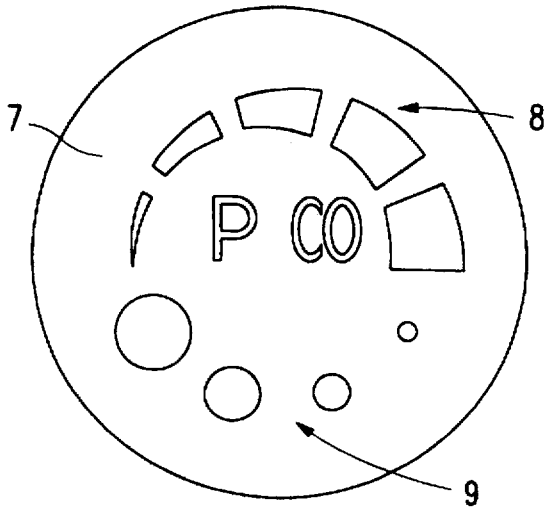

The invention is described below in greater detail, with reference to the accompanying drawing, in which FIG. 1 is a perspective representation of a breathing mask according to the invention, equipped with a display unit, and FIG. 2 depicts, on an enlarged scale, a mechanical light modulator fitted in the display unit of a breathing mask according to the invention.

In FIG. 1 the full-face mask is generally indicated by reference numeral 1. The full-face mask 1 has a visor 2, and to the lower edge 3 of visor, the edge at the same time constituting the seal, there is attached a retainer 4, which can be moved laterally along the lower edge 3. The display unit 5 is fitted in the retainer 4. The measurement data are fed from detectors or from a central unit (not shown in the figure) to the display unit 5 by means of an optical fiber bundle 6. In this construction the display unit is modular, i.e. it is mountable on breathing masks already in use.

FIG. 2 shows one example of the structure of the mechanical light modulator 7. The light modulator 7 is made up of a thin metal film in which the desired symbols 8, 9, P and CO have been produced by laser cutting. The symbols in the light modulator 7 are illuminated from behind by separate light sources, which may be, for example, surface-mounted LEDs or light fibers. In the light modulator 7 shown there are 11 separate signs. By means of the scale 8 at the top therein it is possible, for example, to depict an increase in carbon monoxide concentration, and by means of the circles 9 at the bottom a pressure decrease. A change in the measurement data can be indicated, for example, by a change in the symbol color or by bringing one or more symbols (in FIG. 2, P and CO) into a blinking state. Blinking is an effective alerting method; a person will detect changes in the extreme range of the eye rapidly.

We claim:

1. A breathing mask for use in a hostile environment comprising:

a face mask;

outer measurement data providing means for measuring the hostile environment and providing measurement data representative of the hostile environment;

a display unit carried by said face mask for displaying signs representing measurement data within the visual field of a mask wearer; and means for transferring measurement data from said outer measurement data providing mean to said display unit, said display unit comprising:

a display screen constituted by an opaque film located in the visual field of the wearer and having portions which have been cut away to permanently form areas which are transparent to light and which constitute the signs; and light source means behind said display screen for separately and selectively illuminating each sign independently of all other signs to provide measurement data to the mask wearer in accordance with the signs selected for illumination.

2. A breathing mask according to claim 1, characterized in that said light source means include a separate LED for each sign.

3. A breathing mask according to claim 1, characterized in that said light source means include at least an optical fiber.

4. A breathing mask according to claim 1, characterized in that said display unit additional includes an optical system means for making the display mask to be seen as enlarged and as if at a greater distance than at which it is actually located.

5. A breathing mask according to claim 1, characterized in that it additionally includes a transparent sheet within the visual field of the mask wearer, said transparent sheet reflecting intensively the wavelengths of the light of said light source means, and the light of said light source means coming through the signs of said display mask being directed towards said transparent sheet so as to be reflected to the eyes of the wearer.

6. A breathing mask according to claim 1, characterized in that said signs transmitting measurement data include separate symbols and symbols defining graphic scales.

7. A breathing mask according to claim 1, characterized in that said display unit is positioned inside the full-face mask and said means for transferring measurement data from said outer measurement data providing means to the display unit is a wireless connection.

8. The breathing mask of claim 7 wherein the wireless connection includes one of a radio connection and an inductive loop.

9. A method of transmitting measurement data within the visual field of a full-face, airtight breathing mask wearer, comprising:

selectively activating a first LED to illuminate a first permanently transparent area of a display mask from behind the display mask wherein the first transparent area is permanently shaped as a sign representing a first measurement data; and selectively activating a second LED to illuminate a second permanently transparent area of the display mask from behind the display mask and independently of the illumination of the first transparent area, said second transparent area being permanently shaped as a sign representing a second measurement data.

10. The method of claim 9, further comprising reflecting to the eyes of the breathing mask wearer the light illuminated from the display mask using a sheet substantially transparent to a wavelength other than the wavelengths of the light illuminating the display mask.

11. The method of claim 9 further comprising focusing the light from the display mask so as to enlarge the appearance of the sign areas of the display mask.

12. The method of claim 9 further comprising focusing the light from the display mask so as to increase the apparent distance of the display mask from the eyes of the breathing mask wearer.

13. The method of claim 9 wherein the display mask areas are illuminated through separate optical fibers.

14. The method of claim 9 the display mask has a plurality of sign areas which define a graphic scale.

15. A breathing mask for use in a hostile environment, comprising:

a face mask;

outer measurement data providing means for measuring the hostile environment and providing measurement data representative of the hostile environment;

a display unit carried by said face mask for displaying signs representing measurement data within the visual field of a mask wearer; and means for transferring measurement data from said outer measurement data providing means to said display unit, said display unit comprising:

a light modulator located in the visual field of the mask wearer and having areas which are permanently transparent to light rays and which constitute the signs; and light source means behind said display member for separately and selectively illuminating each sign independently of all other signs to provide measurement data to the mask wearer in accordance with the signs selected for illumination.

16. A breathing mask according to claim 15, characterized in that said light source means include a common LED for a plurality of signs.

17. The method of claim 9 wherein the first and second permanently transparent areas of the display mask are located in the visual field of the mask wearer.

* * * * *